US008938747B2

(12) United States Patent
Huffman et al.

(10) Patent No.: US 8,938,747 B2
(45) Date of Patent: Jan. 20, 2015

(54) RATING MULTIMEDIA PROGRAMS ACCESSED FROM A PROVIDER NETWORK

(75) Inventors: James Huffman, Kansas City, MO (US); Todd W. Jones, Kansas City, MO (US); Brian Wilson, Liberty, MO (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 1087 days.

(21) Appl. No.: 11/952,012

(22) Filed: Dec. 6, 2007

(65) Prior Publication Data

US 2009/0150917 A1 Jun. 11, 2009

(51) Int. Cl.

| | |
|---|---|
| ***H04H 60/33*** | (2008.01) |
| ***H04H 60/64*** | (2008.01) |
| ***H04H 60/31*** | (2008.01) |
| ***H04H 60/32*** | (2008.01) |
| ***H04H 60/66*** | (2008.01) |

(52) U.S. Cl.

CPC ..... *H04H 60/64* (2013.01); *H04H 60/31* (2013.01); *H04H 60/32* (2013.01); *H04H 60/66* (2013.01)

USPC ..... 725/9; 725/12; 725/14; 725/16; 725/58

(58) Field of Classification Search

USPC ..... 725/9–16

See application file for complete search history.

(56) References Cited

U.S. PATENT DOCUMENTS

| | | | | |
|---|---|---|---|---|
| 5,872,588 | A * | 2/1999 | Aras et al. | 725/14 |
| 6,751,219 | B1 * | 6/2004 | Lipp et al. | 370/390 |
| 8,707,366 | B2 * | 4/2014 | Wong et al. | 725/51 |
| 2002/0056087 | A1 * | 5/2002 | Berezowski et al. | 725/9 |
| 2003/0009542 | A1 * | 1/2003 | Kasal et al. | 709/222 |
| 2003/0233656 | A1 * | 12/2003 | Sie et al. | 725/46 |
| 2004/0088729 | A1 | 5/2004 | Petrovic et al. | |
| 2004/0203639 | A1 * | 10/2004 | Ozer et al. | 455/414.1 |
| 2004/0216041 | A1 | 10/2004 | Ajizadeh | |
| 2005/0060738 | A1 | 3/2005 | Stecyk | |
| 2005/0060740 | A1 | 3/2005 | Stecyk | |
| 2006/0010470 | A1 * | 1/2006 | Kurosaki et al. | 725/46 |
| 2006/0218574 | A1 | 9/2006 | Van Horck | |
| 2007/0101394 | A1 * | 5/2007 | Fu et al. | 725/134 |
| 2007/0124756 | A1 * | 5/2007 | Covell et al. | 725/18 |
| 2007/0136753 | A1 | 6/2007 | Bovenschulte et al. | |
| 2007/0157221 | A1 | 7/2007 | Ou et al. | |
| 2007/0192782 | A1 * | 8/2007 | Ramaswamy | 725/9 |
| 2008/0222106 | A1 * | 9/2008 | Rao et al. | 707/3 |
| 2009/0083780 | A1 * | 3/2009 | Beyabani | 725/14 |

* cited by examiner

*Primary Examiner* — Nicholas Corbo

(74) *Attorney, Agent, or Firm* — Jackson Walker L.L.P.

(57) ABSTRACT

A system measures viewership of multimedia programs such as television programs, pay-per-view sporting events, and video-on-demand movies. Viewership data from a plurality of multimedia programs may be compared to determine ratings for the multimedia programs. Multimedia streams en route to set top boxes may be monitored using packet inspection to identify the multimedia program or programs included in the multimedia streams. An electronic table or array may be stored and updated with viewership statistics of monitored multimedia programs. Some embodiments track the total number of households or televisions that are powered on in a viewing area. Ratings are available substantially in real time by accessing a stored table with viewership information or by frequently polling a plurality of stored values to determine which multimedia program is being viewed by all or substantially all viewers in an area.

21 Claims, 3 Drawing Sheets

RATING MULTIMEDIA PROGRAMS ACCESSED FROM A PROVIDER NETWORK

BACKGROUND

1. Field of the Disclosure

The present disclosure generally relates to multimedia provider networks and more particularly to systems and methods for rating multimedia programs accessed from multimedia provider networks.

2. Description of the Related Art

Provider networks provide multimedia content such as television programming to viewers. It can be useful to advertisers and television executives, as examples, to have data related to how many viewers are tuned to a particular television program. Collecting the data can be burdensome if a viewer is responsible for manually providing data regarding received content. Some automatic data collection systems rely on statistics by sampling which programs a test group is watching. Such systems rely on large sample sizes to be accurate and may be ineffective if ratings are not timely provided. Further, some viewers may consider automatic ratings systems that monitor viewing habits using localized hardware to be a violation of privacy. In addition to such problems, providing localized hardware to a statistically significant sample of viewers may be cost prohibitive.

DESCRIPTION OF THE EMBODIMENT(S)

Figure 1:
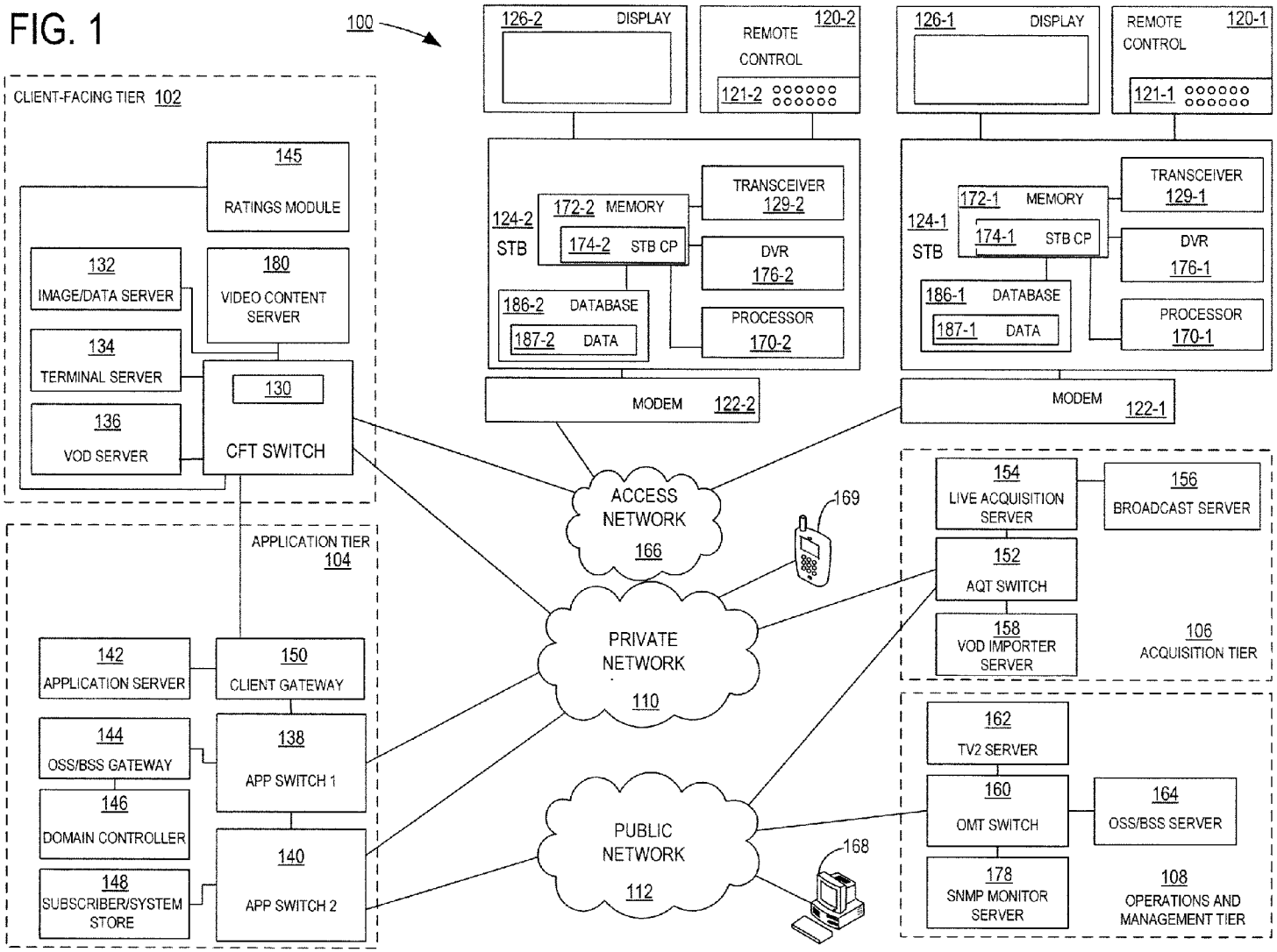
FIG. 1 illustrates a representative Internet Protocol Television (IPTV) system for implementing disclosed embodiments.

In one aspect, a method is disclosed for measuring viewership of multimedia programs. The method includes measuring periodically from within a provider network a number of viewers that are then accessing a plurality of multimedia programs. The plurality of multimedia programs are accessible from the provider network. The method further includes storing a plurality of values indicative of the number of viewers that are accessing the plurality of multimedia programs. In some embodiments, the method includes measuring an average number of viewers for a portion of the plurality of multimedia programs. Additionally, in some embodiments, the method includes measuring whether a plurality of viewers have requested a digital video recorder (DVR) to record a portion of the plurality of multimedia programs. Embodiments may also measure a number of televisions that are powered-on in a viewing area of the provider network. Measuring the number of televisions that are powered-on includes receiving state data for a plurality of set top boxes. Further, measuring the number of viewers that are accessing the plurality of multimedia programs may include polling at preselected intervals for any available set top boxes then served by the provider network. A portion of the plurality of stored identifiers may relate to a multimedia program either then accessed by or recently accessed by a corresponding set top box of the available set top boxes then served by the provider network.

In some embodiments, a stored electronic table has an entry for a portion of the available set top boxes. Further, each entry has a record corresponding to a plurality of preselected intervals. In accordance with such embodiments, the method further includes, substantially at the plurality of preselected intervals, capturing an identifier associated with a multimedia program being accessed by each of the portion of the available set top boxes. The method further includes storing the identifier in the electronic table as a record corresponding to a then-current preselected interval. The record further corresponds to an entry related to one of the portion of available set top boxes.

In another aspect, a computer program stored on a computer readable medium is disclosed. The computer program has instructions operable for measuring periodically from within a provider network the number of viewers that are then accessing a plurality of multimedia programs. The plurality of multimedia programs are accessible from the provider network. The computer program further has instructions for storing a plurality of values indicative of the number of viewers that are accessing the plurality of multimedia programs. Measuring periodically includes polling at preselected intervals a plurality of stored identifiers for any available set top boxes then served by the provider network. Further, a portion of the plurality of stored identifiers relates to a multimedia program either then-accessed by or recently accessed by a corresponding set top box of the available set top boxes then served by the provider network. In alternate embodiments, the computer program has instructions further operable for measuring whether a plurality of viewers have requested a DVR to record a portion of the plurality of multimedia programs. Additionally, further instructions may be operable for measuring a number of televisions that are powered-on in a viewing area of the provider network. Measuring the number of televisions that are powered-on may include receiving state data for a plurality of set top boxes. In accordance with some embodiments, a stored electronic table has an entry for a portion of the available set top boxes, wherein each entry has a record corresponding to a plurality of preselected intervals. In such embodiments, further instructions are operable for capturing an identifier associated with a multimedia program being accessed by each of the portion of the available set top boxes. Other instructions are operable for storing the identifier in the electronic table as a record corresponding to a then-current preselected interval. The record may further correspond to an entry related to one of the portion of available set top boxes.

In the following description, for the purposes of explanation, numerous specific details are set forth in order to provide a thorough understanding of the disclosed embodiments. A person of ordinary skill in the art should recognize that embodiments might be practiced without some of these specific details. In other instances, well-known structures and devices may be shown in block diagram form or omitted for clarity.

Multimedia content such as television programs are often compared using ratings. Ratings are created to measure and classify the popularity of a television program or television channel. The rating of a television program may determine how much is charged for placing advertisements in the television program. Market researchers may judge the effectiveness of an advertisement by knowing the number of viewers that are viewing the advertisement or by knowing the number of viewers that select alternate programming during the advertisement. In addition, television executives may determine which programs are cancelled based on ratings. Ratings may be based on the number of viewers (i.e., viewership) that consume a television program.

Ratings for a television program may be defined using "ratings points". A single ratings point represents 1% of all households in a viewing area (e.g., the United States of America) that have a television. For example, if there are 100,000,000 television-possessing households in a viewing area, a television program having 1 ratings point is estimated to have an average of 1,000,000 viewers at a given moment. "Share" is a ratings metric that represents the percentage of televisions in a viewing area that are powered-on and tuned to a specific program. Television ratings may be reported as ratings points/share. For example, a television program may have a rating of 8.2/10. For a viewing area having 100,000,000 television-possessing households, this rating suggests that an average of 8,200,000 households and 10% of all televisions are tuned to the television program at any given moment.

Some ratings systems require consumers to keep a written record of the television programs they watch throughout the day. Some ratings systems employ "set meters," which are small electronic appliances connected to televisions for monitoring what content is viewed. Set meters may gather viewership data and transmit the information periodically to market researchers. "People meters" may also be employed by some ratings systems. People meters are similar to set meters but also collect viewership data specific to each family member in a household. Such ratings systems may be inaccurate due to the sample size of homes used to collect viewership data. In addition, some consumers consider it an invasion of privacy to have their viewing habits monitored from within their homes. Further, placing set meters or people meters in a large number of homes may be cost prohibitive. Still further, skewed viewership data may result from a consumer knowing that a set meter is recording his or her viewing habits.

Disclosed embodiments provide content providers with substantially real time viewership data. For example, a content provider may determine by monitoring, at the point of distribution for multimedia content, the number of viewers for channels in a specific geographic region or user-defined area. In some embodiments, a market researcher may access a web-based front end to receive viewership data as set top boxes request and view channels. By collecting the data from network edge devices that serve each household, an accurate and prompt inventory can be collected. Content providers responsible for purchasing television and multimedia content may use the collected information to determine the worth of television programs, movies, and sporting events that the content provider will offer to consumers. Embodied systems do not necessarily rely on collecting statistically significant samples using set meters and do not necessarily require a consumer to complete a viewership log. Instead, viewership data is automatically and rapidly collected and compiled as multimedia content is provided to the consumers. Therefore, embodied systems provide accurate collection of viewership data without undergoing the expense of set meters for every sampled home. Further, by collecting viewership data upstream of a consumer's home, the consumer is less likely to sense an intrusion of privacy that may occur by having a set meter or people meter in the consumer's residence.

Some embodiments employ viewership data mining using edge devices or near-edge devices within a content provider infrastructure to collect accurate and timely data substantially in real time. Edge-devices, for example routers, switches, multiplexers, and servers, may be used to collect real time viewership data. Alternatively, hardware or software systems in communication with such edge-devices may be used. Viewership data may be accessed through a secure web based front end and sold to market researchers or producers of television content. Such accurate and real time viewership data may provide multimedia content owners the ability to quickly modify what content is provided to keep ratings high. Television producers may utilize the accurate, substantially real time ratings as a form of feed-back and may make real time changes in multimedia content to maximize the number of viewing consumers.

Tracking and trend building of customer viewing habits (i.e., viewership data) is a benefit of disclosed systems. Accumulated data may be sold to advertisers or used by a content provider to negotiate with those who supply syndicated television programs, for example. An additional benefit relates to planning maintenance windows, which may be scheduled during times that relatively low data traffic is expected. Ratings points, shares, and "houses using television" (HUT) calculations can be determined with considerable accuracy. Viewership data related to sporting events or video on demand (VOD) programming may also be tracked. In some embodiments, information regarding whether programming is recorded is collected. In addition, data may be collected regarding whether a consumer fast-forwards through certain multimedia content.

Television programs, movies, radio programming and other multimedia content may be distributed over telephone company networks, coaxial-based networks, satellite transmissions, WiFi transmission, WiMAX transmission, and the like. In some systems, for example traditional coaxial-based "cable" systems, a content provider may distribute through the same coaxial or fiber-optic cable a compound signal containing a number of television channels at different frequencies. In conjunction, a set top box or a tuner within a television, radio, or recorder selects one or more channels from the compound signal to play or record. In contrast to such systems that simultaneously distribute every available channel at all times, IPTV systems generally distribute content only in response to user requests. Such IPTV systems typically use Internet Protocol (IP) and other technologies found in computer networks. To provide IPTV, a user's telephone lines may be used in some combination with a residential gateway (RG), a digital subscriber line (DSL) modem, a set top box (STB), a display, and other such equipment to receive and convert into usable form the multimedia content provided from a telephone company network, for example.

Traditional broadcast services, for example some coaxial-based networks, transmit all available programs to all consumers on the network at all times. In a switched digital broadcast system, television channels are transmitted to a consumer only when specifically requested by the consumer. In an illustrative embodiment, programs are broadcast from a content provider's transmission facility (i.e., "headend") onto a local network only when requested by a consumer. Specifically, when a consumer selects a program for viewing through an interactive program guide (i.e., an electronic programming guide (EPG)) an application determines whether the requested program is currently being broadcast on a local network. If so, the set top box of the requesting consumer may tune into the local broadcast. If the program is not currently being sent to the local network, then the set top box of the requesting consumer may request from a server application to being broadcasting the requested content. Accordingly, switched broadcasting delivers to a consumer only the content that the consumer requests.

IPTV providers, satellite-based providers, digital cable providers, and others may distribute multimedia content using bidirectional (i.e., two-way) communication between a user's customer premises equipment (CPE) and the content provider's equipment. Bidirectional communication allows a content provider to offer advanced features, such as VOD, pay-per-view, advanced programming information, text-based news, and the like.

Referring now to the drawings, FIG. 1 illustrates selected aspects of an IPTV system 100 operated as part of a provider network. Throughout this disclosure, a hyphenated form of a reference numeral refers to a specific instance of an element and the un-hyphenated form of the reference numeral refers to the element generically or collectively. Thus, for example, reference numeral 124-1 refers to an instance of an element 124. As shown in FIG. 1, IPTV system 100 includes two STBs 124 including STB 124-1 and STB 124-2. In the depicted embodiment, STBs 124 communicate through private access network 166 via modems 122 (i.e., modem 122-1 and modem 122-2).

As shown, IPTV system 100 is configured to provide multimedia content to users of STBs 124 and includes a client facing tier 102, an application tier 104, an acquisition tier 106, and an operations and management tier 108. In addition, IPTV system 100 may provide multimedia content to personal computer 168 and mobile device 169, which may be a mobile telephone. Each tier 102, 104, 106 and 108 is coupled to a private network 110, to a public network 112 (e.g., the Internet), or to both the private network 110 and the public network 112. Any of the various tiers coupled to the various networks may communicate with each other over the networks. For example, as shown, the client-facing tier 102 may communicate through the private network 110 with the acquisition tier 106. Further, as shown, the application tier 104 may communicate through the private network 110 and the public network 112 with the acquisition tier 106. The interconnections between illustrated tiers and networks in FIG. 1 are meant as instructive and not limiting.

As shown, IPTV system 100 distributes multimedia content to users of STBs 124 for viewing on displays 126 and possibly for sending to other components not shown, such as a portable media player. In order to distribute the multimedia content, IPTV system 100 must first gain access to the multimedia content. To that end, acquisition tier 106 represents a variety of systems to acquire multimedia content, reformat it when necessary, and prepare it for transmission over private network 110 or public network 112. In its capacity at acquiring and distributing multimedia for use on IPTV system 100, acquisition tier 106 serves as a "content headend." Acquisition tier 106 may include, for example, systems for capturing analog and/or digital content feeds, either directly from a content provider or from a content aggregation facility. Content feeds transmitted via VHF/UHF broadcast signals may be captured by broadcast server 156. Similarly, live acquisition server 154 may capture satellite signals, high-speed fiber feeds, or programming feeds sent over other suitable transmission means. Content feeds to live acquisition server 154 may include broadcasted multimedia content, for example premium audio/video programming (i.e., traditional "cable channels") widely available but not typically broadcast over airwaves. Acquisition tier 106 may further include signal conditioning systems and content preparation systems for encoding content. As shown, acquisition tier 106 includes VOD importer server 158 and may include a digital rights management (DRM) server for encrypting content (not shown). VOD importer server 158 receives content from one or more VOD sources that may be outside the IPTV system 100, for example discs or transmitted feeds. VOD importer server 158 may temporarily store multimedia content for transmission to a VOD server 136 on client-facing tier 102. In addition, the VOD content may be stored at one or more servers, such as the VOD server 136. The stored VOD content may be distributed by multicast (i.e., a single stream sent simultaneously to multiple viewers) or by unicast to individual users in a VOD system.

After acquiring the multimedia content, IPTV system 100 distributes the content over private network 110, for example. Private network 110 may be referred to as a "core network." In some embodiments, private network 110 consists of a fiber backbone (i.e., WAN) and one or more video hub offices (VHOs). Generally, private network 110 transports multimedia content (e.g., video, music, Web pages, channel lineups, and data) from the acquisition tier 106 to STBs 124 through private access network 166 (via client-facing tier (CFT) switch 130). In this role, private network 110 serves as the "backbone" for IPTV system 100. In a large deployment of IPTV system 100 that covers a vast geographic region, private network 110 may represent several smaller networks that each may only transfer content within a subset of the region. Accordingly, private network 110 may provide for the insertion of local content that is relevant only to a subset region. For example, private network 110 may allow for the localized insertion of local advertisements or local emergency alert systems for a particular service area.

In an illustrative embodiment, real time ratings module 145 operates within client-facing tier 102 to monitor in real time or substantially in real time the number of consumers viewing a particular channel, VOD program, pay-per-view event, television program, or other multimedia event or broadcast. As shown, real time ratings module 145 may be operatively coupled to CFT switch 130. In operation, real time ratings module 145, alone or in conjunction with CFT switch 130, may track multimedia content that is requested and viewed by consumers, for example users of STBs 124-1 and 124-2. To this end, traffic monitoring may be implemented, such as by conducting port-mirroring to monitor packets sent over private access network 166 to STB 124-2 and STB 124-1, as examples. Alternatively, real time ratings module 145 may be communicatively coupled to some combination of video content server 180, image/data server 132, terminal server 134, and VOD server 136 to monitor traffic destined for consumers, for example users of STB 124-1 and STB 124-2. In this way, viewership data for a particular multimedia program may be registered and stored in real time or substantially in real time.

To illustrate the distribution of multimedia content acquired by acquisition tier 106, in an example embodiment, broadcast server 156 acquires broadcast multimedia content and communicates it to live acquisition server 154. Live acquisition server 154 transmits the multimedia content to the AQT (AcQuisition Tier) switch 152. In turn, the AQT switch 152 transmits the multimedia content to the CFT switch 130, for example, via the private network 110. As shown, the CFT switch 130 may communicate the multimedia content through modems 122 via the private access network 166. In some embodiments, STBs 124 receive the multimedia content via modems 122 and transmit it to displays 126.

In some embodiments, live acquisition server 154 and VOD importer server 158 take numerous data streams and encode them into a digital video format, such as MPEG-2, or MPEG-4. After encoding, data streams may be encapsulated into IP data streams and transmitted to specific IP destinations (e.g., STBs 124) in response to a user's request for a particular channel, for example. Video content server 180, VOD server 136, or image/data server 132 may act as an intermediary or repository for multimedia content obtained and encoded by acquisition tier 106. In some embodiments, multimedia content is transmitted to the video content server 180, where it is encoded, formatted, stored, or otherwise manipulated and prepared for communication to the STB 124.

As shown, IPTV system 100 includes private access network 166. Private access network 166 provides a network link from the private network 110 to each consumer's location. To this end, private access network 166 provides a network translation as necessary from a switched network, for example, to the access technology used to transmit data and multimedia content to the consumer's location. For example, a content provider that uses twisted-pair telephone lines to deliver multimedia content to consumers may utilize digital subscriber lines within private access network 166. The digital subscriber lines may utilize some combination of DSL, DSL2, DSL2+, ADSL, VDSL or other technologies. In some embodiments, private access network 166 may use fiber-to-the-home (FTTH). In such cases, optical fiber may be used all the way to the consumer's location to provide high-bandwidth. In other embodiments, fiber-to-the-curb (FTTC) deployments are used to deliver multimedia content to consumers. In such cases, a digital subscriber line access multiplexer (DSLAM) may be used within private access network 166 to transfer signals containing multimedia content from optical fiber to copper wire for DSL delivery to consumers. In other embodiments, private access network 166 may use radio frequency (RF) signals sent over coaxial cables. Accordingly, private access network 166 may utilize quadrature amplitude modulation (QAM) equipment for downstream traffic. In these systems, private access network 166 may receive upstream traffic from a consumer's location using quadrature phase shift keying (QPSK) modulated RF signals. In such systems, a cable modem termination system (CMTS) may be used to mediate between IP-based traffic on private network 110 and private access network 166.

In operation, if a user requests VOD content via a STB 124, the request may be transmitted over the private access network 166 to VOD server 136, via the CFT switch 130. Upon receiving the request, the VOD server 136 retrieves or accesses the requested VOD content and transmits the content to the STB 124 across private access network 166 via CFT switch 130. In turn, STB 124 transmits relevant video portions of the VOD content to the display 126. STB 124 may transmit audio portions of the VOD content to a stereo system (not shown) or may allow (or disallow) sending the VOD content to a recording device (not shown).

As shown, IPTV system 100 includes application tier 104. As shown, application tier 104 communicates with acquisition tier 106 and client-facing tier 102 through private network 110. Application tier 104 may communicate through various communication protocols including hypertext transfer protocol (HTTP). Generally, application tier 104 may include notification servers, billing servers, and any of a variety of subscriber application servers employed by an owner or operator (i.e., network content provider) of IPTV system 100. In some embodiments, elements of the application tier 104 such as client gateway 150 communicate directly with the client-facing tier 102. The components of client-facing tier 102 may communicate using HTTP, transmission control protocol (TCP) or datagram protocol (UDP), as examples.

As illustrated in FIG. 1, the client-facing tier 102 is coupled for communication with user equipment (e.g., modems 122) via private access network 166. Private access network 166 may be referred to as the "last mile" for a content provider or network operator. It provides network connectivity of IPTV services to consumers' locations. Client-facing tier 102 may be required to multicast multimedia content to multiple destinations. For example, the same multimedia content may be distributed substantially simultaneously to STB 124-1 and STB 124-2. In contrast to a multicast or a unicast, some embodiments "broadcast" programming or data to all users on a network as a "broadcast" transmission. For example, a TV guide feature for displaying available programming may be broadcast to every user. Regardless of whether multimedia content is distributed using a unicast, a multicast, or a broadcast, in accordance with disclosed embodiments, client-facing tier 102 and its components may be configured to track viewership data and provide real time ratings to market researchers and other users. For example, real time ratings module 145 may host a web page or otherwise provide access to data by a user of personal computer 168. The user of personal computer 168 may monitor a graphical user interface to determine the share of a particular television program that is then being displayed on displays 126-1 and 126-2. If the user of personal computer 168 is a multimedia content owner or producer responsible for the content available to displays 126, then having access to real time ratings may provide the user the opportunity to modify the content during the broadcast to increase the chances for higher viewership.

To deliver multimedia content, client-facing tier 102 may employ any current or future Internet protocols for providing reliable real time streaming multimedia content. In addition to the TCP, UDP, and HTTP protocols discussed above, such protocols may use, in various combinations, other protocols including, file transfer protocol (FTP), real time transport protocol (RTP), real time control protocol (RTCP), and real time streaming protocol (RTSP), as examples. In some embodiments, client-facing tier 102 sends multimedia content encapsulated into IP packets over private access network 166. For example, an MPEG-2 transport stream may be sent, in which the transport stream consists of a series of 188-byte transport packets, for example. To ensure quality of service, protocols should be chosen that minimize dropped packets, jitter, delay, data corruption, and other errors.

As shown, the client-facing tier 102 may communicate with a large number of STBs, such as representative STBs 124, over a wide area, which may be, for example, a regional area, a metropolitan area, a viewing area, a designated market area, or any other suitable geographic area, market area, or user group supported by networking the client-facing tier 102 to numerous STBs. In an illustrative embodiment, the client-facing tier 102, or any portion thereof, may be included at a video headend office (not depicted).

In some embodiments, the client-facing tier 102 may be coupled to modems 122 via fiber optic cables. Alternatively, modems 122 may be DSL modems coupled to one or more network nodes via twisted pairs. Each STB 124 may process data received over the private access network 166 via various IPTV software platforms that are commonly known.

In an illustrative embodiment, the client-facing tier 102 includes a CFT switch 130 that manages communication between the client-facing tier 102 and the private access network 166. CFT switch 130 also manages communication between the client-facing tier 102 and the private network 110 and is coupled to an image/data server 132 that may store streaming multimedia content and possibly still images associated with programs of various IPTV channels. Image/data server 132 stores data related to various channels, for example, types of data related to the channels and to programs or video content displayed via the channels. In an illustrative embodiment, image/data server 132 may be a cluster of servers, each of which may store streaming multimedia content, still images, channel and program-related data, or any combination thereof. CFT switch 130 may also be coupled to terminal server 134 that provides terminal devices with a connection point to the private network 110. As shown, CFT switch 130 may also be coupled to VOD server 136 that stores or provides VOD content imported by the IPTV system 100. As shown, the client-facing tier 102 also includes video content server 180 that transmits video content requested by viewers to STBs 124. In some embodiments, video content server 180 includes one or more multicast servers.

As illustrated in FIG. 1, application tier 104 may communicate with numerous components through private network 110 and public network 112. As shown, application tier 104 includes a first application tier (APP) switch 138 and a second APP switch 140. The first APP switch 138 is coupled to the second APP switch 140 and a combination operation-systems-support (OSS) and billing-systems-support (BSS) gateway 144 (i.e., OSS/BSS gateway 144). In some embodiments, the OSS/BSS gateway 144 controls access to an OSS/BSS server 164 that stores operations and billing systems data. As shown, OSS/BSS server 164 communicates with service delivery platform ("SDP") 203.

As shown, application tier 104 includes application server 142. Application server 142 may be any data processing system with associated software that provides information services (i.e., applications) for clients or users. Application server 142 may be optimized to provide services including conferencing, voicemail, and unified messaging. In some embodiments, services include electronic programming guides (EPG), conditional access systems (CAS), DRM servers, a navigation/middleware server, and IPTV portal, e-mail services, and remote diagnostics.

As shown in FIG. 1, second APP switch 140 is communicatively coupled to a domain controller 146 that provides web access, for example, to users via the public network 112. The second APP switch 140 is communicatively coupled to a subscriber/system store 148 that includes account information, such as account information that is associated with users who access the IPTV system 100 via the private network 110 or the public network 112. Therefore, for example, a user may employ a personal computer 168 to receive IPTV account information via the public network 112. Similarly, a user may employ mobile device 169 or another similar multifunction device over private network 110 or public network 112 to receive information through second APP switch 140. In some embodiments, application tier 104 may also include a client gateway 150 that communicates data directly with the client-facing tier 102. In these embodiments, the client gateway 150 may be coupled directly to the CFT switch 130. Accordingly, the client gateway 150 may provide user access to the private network 110 and the tiers coupled thereto.

In some embodiments, STB 124 accesses the IPTV system 100 via the private access network 166, using information received from the client gateway 150. In such embodiments, private access network 166 may provide security for the private network 110. Therefore, user devices may access the client gateway 150 via the private access network 166, and the client gateway 150 may allow such devices to access the private network 110 once the devices are authenticated or verified. Similarly, the client gateway 150 may prevent unauthorized devices, such as hacker computers or stolen STBs, from accessing the private network 110, by denying access to these devices beyond the private access network 166.

Accordingly, in some embodiments, when a STB 124 accesses the IPTV system 100 via the private access network 166, the client gateway 150 verifies user information by communicating with the subscriber/system store 148 via the private network 110, the first APP switch 138, and the second APP switch 140. The client gateway 150 verifies billing information and user status by communicating with the OSS/BSS gateway 144 via the private network 110 and the first APP switch 138. The OSS/BSS gateway 144 may transmit a query across the first APP switch 138, to the second APP switch 140, and the second APP switch 140 may communicate the query across the public network 112 to the OSS/BSS server 164. Upon the client gateway 150 confirming user and/or billing information, the client gateway 150 allows the STB 124 access to IPTV content, VOD content, and other services. If the client gateway 150 cannot verify user information for the STB 124, for example, because it is connected to an unauthorized twisted pair or residential gateway, the client gateway 150 may block transmissions to and from the STB 124 beyond the private access network 166.

STBs 124 convert digital compressed signals into a format suitable for display. STBs 124 have functionality for recognizing and acting on IP packets, for example UDPs transmitted within IP datagrams. STBs 124 may contain software or firmware coding for sending requests to application server 142, for example, to receive requested programming or data. In some embodiments, requests for content (e.g., VOD content) flow through a billing or management server to verify that a user is not in arrears regarding payment. In some embodiments, STB 124 supports Web browsing on the Internet (e.g., public network 112) and may support cycling through guide data, for example, using Web services. Each STB 124 may be enabled for viewing e-mail, viewing e-mail attachments, and interfacing with various types of home networks.

In accordance with disclosed embodiments, each STB 124 may be a cable box, a satellite box, or an electronic programming guide box. Further, although shown separately, STBs 124 may be incorporated into any multifunctional device such as, a television, a videocassette recorder, a digital video recorder, a computer, a personal computer media player, or other media device. Generally, STBs 124 each represent a dedicated data processing system (e.g., computer) that provides an interface between a display and a content provider. As shown, STBs 124 are connected to the content provider through modems 122. Although modems are shown in FIG. 1, other RGs may be employed. Alternatively, STBs 124 may be connected directly to private access network 166.

STBs 124 contain software or firmware instructions stored in memories 172 or other storage for receiving and processing input from remote controls 120. In some embodiments, STBs 124 are IP based STBs and have capability for outputting resultant multimedia signals (e.g., streaming audio/video) in various formats including S-video, composite video, high definition component video, high definition multimedia interface (HTMI), and video graphics array (VGA) signals. The resultant multimedia signals may support displays 126 that have various video modes including analog NTSC, 1080i, 1080p, 480i, 480p, 720p, as examples. In some embodiments, STBs 124 communicate with modems 122 over local area networks (LANs) connected using CAT5 cables, CAT6 cables, wireless interfaces, or a Home Phoneline Networking Alliance (HPNA) network, as examples.

As shown STBs 124 are coupled to displays 126. Each display 126 may include a cathode ray tube (CRT), television, monitor, projected image, liquid crystal display (LCD) screen, holograph, or other graphical equipment.

STBs 124 communicate with remote controls 120. STBs 124 may include wireless transceivers 129 to communicate with wireless transceivers (not shown) of remote controls 120. Although the term "buttons" may be used to describe some embodiments herein, other forms of input may be used. For example, touch screens associated with remote controls 120 may be used to accept user input. Alternatively, remote controls 120 may be used in conjunction with STBs 124 to operate graphical user interfaces (GUIs) displayed on displays 126.

STBs 124 may receive multimedia data including video content and audio content from the client-facing tier 102 via the private access network 166. The multimedia content may be associated with a broadcast program that includes streaming multimedia content. The multimedia content may include VOD presentations and pay-per-view sporting events. The multimedia content may include pod casts, web casts, or audio files used for playing on portable audio devices, as examples. As it receives data that includes the multimedia content, STB 124 may store the content or may format the content into a resultant multimedia signal for sending to displays 126 and other equipment (not shown) for producing portions of the multimedia content in usable form.

As shown, each STB 124 includes an STB processor 170 and an STB memory 172 that is accessible by STB processor 170. An STB computer program (STB CP) 174, as shown, is embedded within each STB memory 172. As shown, memories 172 are coupled with databases 186 that each include data 187. In addition, data 187 may contain information regarding user preferences associated with STBs 124.

In addition to or in conjunction with STB components illustrated in FIG. 1, STBs 124 may contain modules for transport, de-multiplexing, audio/video encoding and decoding, audio digital to analog converting, and RF modulation. For clarity, such details for these modules are not shown in FIG. 1. In addition, details are not provided for allowing STBs 124 to communicate through private access network 166 through modems 122. However, such communications can be carried out with known protocols and systems for network interfacing such as conventional network interface cards (NICs) used in personal computer platforms. For example STB 124 may use a network interface that implements level 1 (physical) and level 2 (data link) layers of a standard communication protocol stack by enabling access to a twisted pair or other form of physical network medium and supporting low level addressing using media access control (MAC) addressing. In these embodiments, STBs 124 may each have a network interface including a globally unique 48-bit MAC address stored in a read only memory (ROM) or other persistent storage element. Similarly, each modem 122 (or other RG) may have a network interface (not depicted) with its own globally unique MAC address. Further, although STBs 124 are depicted with various functions in separate components, these components may be implemented with a system on chip (SoC) device that integrates two or more components.

As shown, STBs 124 may also include a video content storage module, such as a DVR 176. In a particular embodiment, STBs 124 may communicate commands received from the remote control devices 120 to the client-facing tier 102 via the private access network 166. Commands received from the remote control devices 120 may be entered via buttons 121.

IPTV system 100 includes an operations and management tier 108 that has an operations and management tier (OMT) switch 160. OMT switch 160 conducts communication between the operations and management tier 108 and the public network 112. The OMT switch 160 is coupled to a TV2 server 162. Additionally, the OMT switch 160 as shown is coupled to an OSS/BSS server 164 and to a simple network management protocol (SNMP) monitor server 178 that monitors network devices within or coupled to the IPTV system 100. In some embodiments, the OMT switch 160 communicates with the AQT switch 152 via the public network 112.

In an illustrative embodiment, the live acquisition server 154 transmits the multimedia content to the AQT switch 152, and the AQT switch 152, in turn, transmits the multimedia content to the OMT switch 160 via the public network 112. In turn, the OMT switch 160 transmits the multimedia content to the TV2 server 162 for display to users accessing the user interface at the TV2 server 162. For example, a user may access the TV2 server 162 using a personal computer (PC) 168 coupled to the public network 112.

Figure 2:
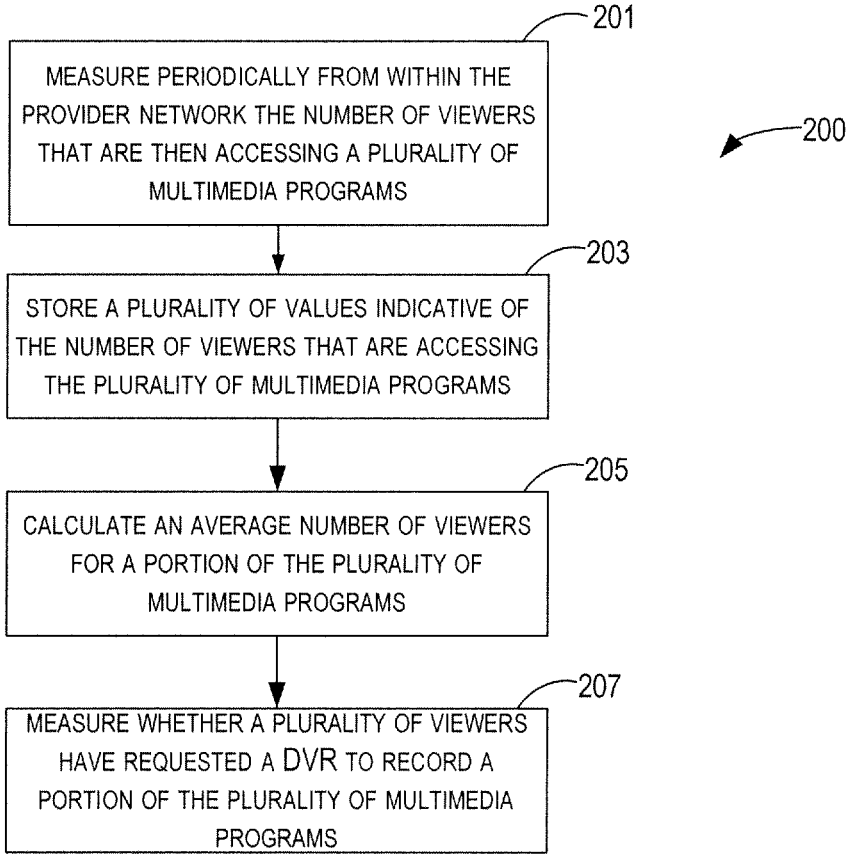
FIG. 2 illustrates a methodology for automatically obtaining real time ratings for multimedia programs available from a provider network.

FIG. 2 illustrates representative operations of a methodology 200 for measuring real time ratings for multimedia content. The IPTV system illustrated in FIG. 1 may be used to perform methodology 200. Operation 201 relates to measuring periodically from within a provider network the number of viewers that are accessing a plurality of multimedia programs. Measuring may occur substantially in real time by polling an electronic array or table that stores the most recent channel accessed by every available, active STB in a viewing area. In accordance with some embodiments, the electronic array or table is automatically updated each time a consumer, through a CPE such as a STB or RG, requests an alternate channel. If the electronic array is indexed by a channel number, for example, embodied systems may time-stamp each request, that is recorded in the electronic array. Embodied systems may then cross reference the stored, time-stamped array entry with an EPG to determine which program was viewed by a consumer. In some embodiments, a STB or other CPE transmits a value representing the duration of time spent watching a particular channel or event to a network-based ratings server. The value representing the duration of time spent watching a particular channel or event may be used in calculating the viewership for a channel.

In accordance with disclosed embodiments, ratings for a plurality of multimedia programs are calculated using viewership data obtained by network-based equipment that is communicatively coupled to a provider network for accessing which channels or events are being requested and consumed by viewers. Example multimedia programs that may be rated include VOD movies, pay-per-view sporting events, and the like. In some embodiments, multiple network-based appliances may be deployed for assessing the viewership of a plurality of channels or multimedia programs. In some embodiments, such network devices for assessing viewership in real time reside near or at a network edge. For example, a client-facing tier switch or an apparatus in communication with a client-facing tier switch may operate to process consumer requests and store associated data used in measuring the viewership of multimedia programs. Alternatively, port-mirroring and packet inspection may be carried out to determine which of a plurality of multimedia programs is destined for a plurality of viewers. For example, a network edge device may examine a plurality of packet headers for packets that are destined to a consumer's STB. Specifically, the packet headers may be processed to translate a watermark or other identifier that may be embedded in the packet for determining the name of the multimedia program destined for the consumer's STB. In addition, the packet headers may contain a field with the destination IP address for the associated packet. The destination IP address may identify the RG or STB that is requesting the multimedia program, and this information may be used in determining the physical location or viewing area that is to receive the packet. Accordingly, packet inspection may be undertaken as a step in determining real time or substantially real time ratings for multimedia programs for a particular viewing area or set of viewing areas.

As shown in FIG. 2, operation 203 relates to storing a plurality of values indicative of the number of viewers that are accessing a plurality of multimedia programs. For example, a real time ratings server, upon obtaining viewership data during operation 201, may store into an electronic array or table, entries used in determining which multimedia events are being accessed by consumers in a particular viewing area. Viewership data entries may have associated time stamps or duration data for measuring the length of time a consumer has viewed a particular multimedia program. Such data, for example, may be used in weighting the ratings associated with a particular multimedia event. As shown, operation 205 relates to calculating an average number of viewers for a portion of the plurality of multimedia programs. The portion of the plurality of multimedia programs may include all television programs accessible in a viewing area, for example. As another example, the portion of the plurality of multimedia programs may include the television programs that are of interest to a market researcher. In some embodiments, to calculate an average number of viewers for a multimedia program such as a television program, the stored values from operation 203 may be accessed. For example, if viewership for a one-hour-long television program is calculated every minute, the number of viewers that are measured at each one-minute interval during the television program's broadcast may be added together and divided by 60 to obtain the average number of viewers during the television broadcast. Special considerations may be taken if the television program is being recorded by a DVR or STB with recording capabilities. Conceivably, a network edge device that measures viewership for a television program may count as being viewed instances in which a DVR or other device is merely recording the program. Some embodiments may ping the DVR or STB or request an update from such devices in the event that the television program is later viewed. In response, stored viewership data may be updated to reflect the information later received regarding whether consumer actually viewed the multimedia content stored to the DVR or other device. In addition to calculating the average number of viewers in operation 205, other statistical operations may be performed. Further, certain ratings may be based on the total number of televisions or STBs that are powered on. As a result, some embodiments are equipped for determining, measuring, or estimating a total number of STBs or televisions that are powered-on in a viewing area. When possible, some embodiments may also determine whether a television attached to a STB is powered-on. In the event a STB or television is powered-on, but has not received any user input for a predetermined time (i.e., a timeout situation), some embodiments may prompt a consumer through a television display or audibly, as examples, to verify that he or she is still watching the multimedia program that is undergoing the rating.

As shown in FIG. 2, methodology 200 includes an optional operation 207 for measuring whether a plurality of viewers have requested a DVR to record a portion of the plurality of multimedia programs. In some embodiments, a network-based scheduler may be pinged or notified upon a STB or DVR receiving a request to record a multimedia event that is scheduled for a future broadcast. In such cases, a ratings server or other device may be in communication with the network-based scheduler to determine that a multimedia event is scheduled for recording in accordance with operation 207. If a multimedia event is recorded during the broadcast, a ratings server may later request the STB or DVR ping the ratings server or otherwise provide a notification each time the program is watched. In addition, information regarding whether certain parts of the multimedia event, for example the commercials, were skipped during viewing. Accordingly, operation 207 may help determine whether viewership numbers measured in step 201 are skewed by DVRs or STBs that record multimedia programs during broadcast. In such a case, stored values may be adjusted to account for DVRs and STBs that automatically record the multimedia content without a consumer ever watching the multimedia content.

Figure 3:
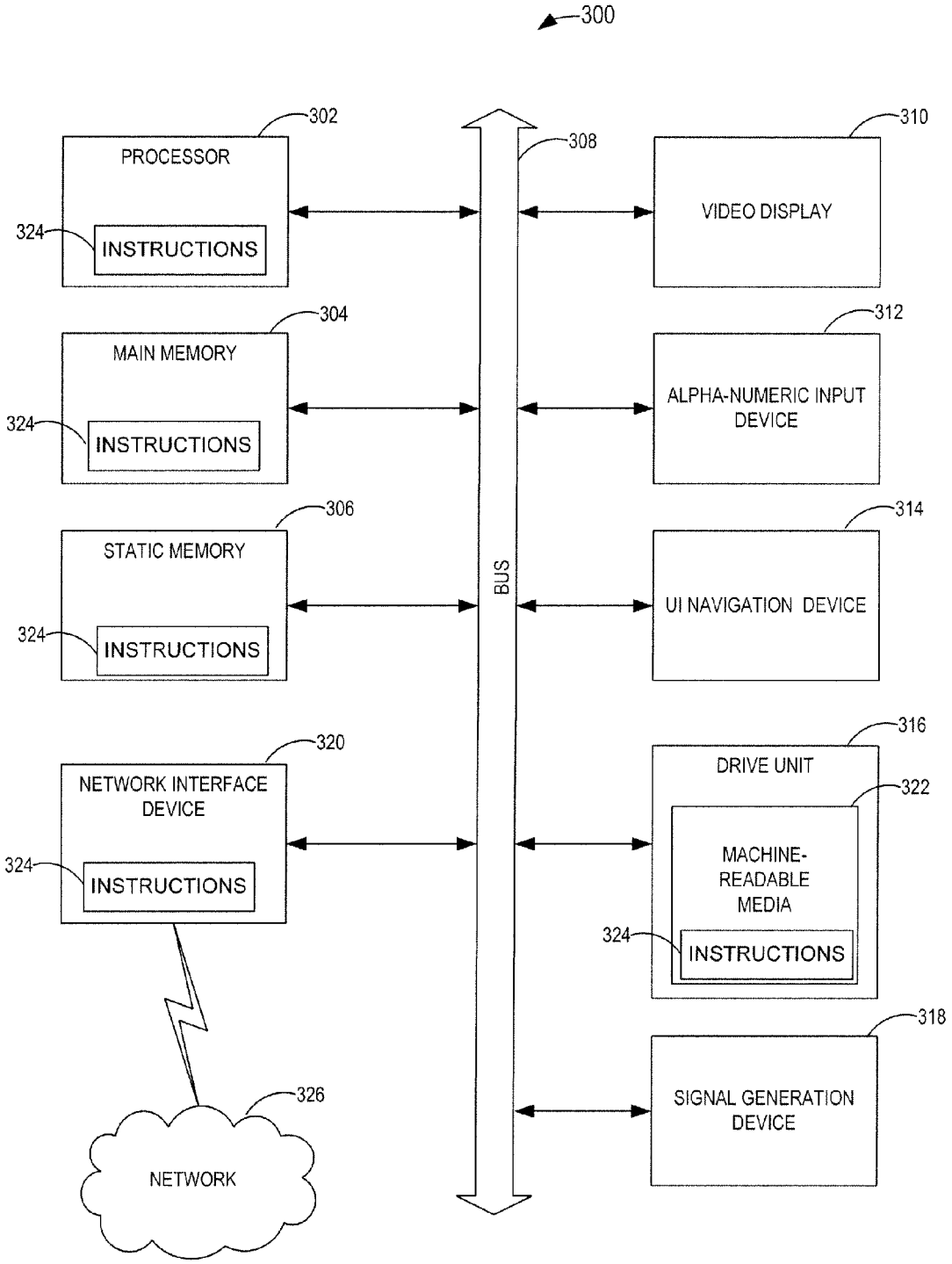
FIG. 3 illustrates a data processing system for use with disclosed embodiments.

FIG. 3 illustrates in block diagram form a data processing system 300 within which a set of instructions may operate to perform one or more of the methodologies discussed herein. Data processing system 300 may operate as a standalone device or may be connected (e.g., networked) to other data processing systems. In a networked deployment, data processing system 300 may operate in the capacity of a server or a client data processing system in a server-client network environment, or as a peer computer in a peer-to-peer (or distributed) network environment. Example data processing systems include, but are not limited to a DVR, a personal computer (PC), a tablet PC, STB, a cable box, a satellite box, an EPG box, a personal digital assistant PDA, a cellular telephone, a smart phone, a web appliance, a network router, a switch, a bridge, a server, or any machine capable of executing a set of instructions (sequential or otherwise) that specify actions to be taken by that machine. Further, while only a single data processing system is illustrated, the term "data processing system" shall also be taken to include any collection of data processing systems that individually or jointly execute a set (or multiple sets) of instructions to perform any one or more of the methodologies discussed herein.

As shown, data processing system 300 includes a processor 302 (e.g., a central processing unit, a graphics processing unit, or both), a main memory 304, and a static memory 306 that may communicate with each other via a bus 308. In some embodiments, the main memory 304 and/or the static memory 306 may be used to store the indicators or values that relate to multimedia content accessed or requested by a consumer. Data processing system 300 may further include a video display unit 310 (e.g., a television, an LCD or a CRT) on which to display multimedia content such as pay-per-view sporting events, television programs, VOD movies, and the like. Data processing system 300 also includes an alphanumeric input device 312 (e.g., a keyboard or a remote control), a user interface (UI) navigation device 314 (e.g., a remote control or a mouse), a disk drive unit 316, a signal generation device 318 (e.g., a speaker) and a network interface device 320. The input device 312 and/or the UI navigation device 314 (e.g., the remote control) may include a processor (not shown), and a memory (not shown). The disk drive unit 316 includes a machine-readable medium 322 that may have stored thereon one or more sets of instructions and data structures (e.g., instructions 324) embodying or utilized by any one or more of the methodologies or functions described herein. The instructions 324 may also reside, completely or at least partially, within the main memory 304, within static memory 306, within network interface device 320, and/or within the processor 302 during execution thereof by the data processing system 300.

The instructions 324 may further be transmitted or received over a network 326 (e.g., a content provider) via the network interface device 320 utilizing any one of a number of transfer protocols (e.g., broadcast transmissions, HTTP). While the machine-readable medium 322 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine (i.e., data processing system) and that cause the machine to perform any one or more of the methodologies of the present invention, or that is capable of storing, encoding or carrying data structures utilized by or associated with such a set of instructions. The term "machine-readable medium" shall accordingly be taken to include, but not be limited to, solid-state memories, optical and magnetic media, and carrier wave signals.

While the disclosed systems may be described in connection with one or more embodiments, it is not intended to limit the subject matter of the claims to the particular forms set forth. On the contrary, it is intended to cover such alternatives, modifications and equivalents as may be included within the spirit and scope of the subject matter as defined by the appended claims.

What is claimed is:

1. A method for measuring viewership of multimedia programs accessible to customer premises equipment devices, the method comprising:

accessing, in a most recent channel table, information indicative of a most recent channel accessed by each customer premises equipment device in a viewing area;

updating the most recent channel table in response to detecting a customer premises equipment device in the viewing area requesting a channel change; and determining, from the most recent channel table, a popularity of a first multimedia program;

wherein determining the popularity includes:

determining a number of customer premises equipment devices accessing the first multimedia program;

determining a number of customer premises equipment devices recording the first multimedia program;

requesting the customer premises equipment devices recording the program to provide notification in response to a subsequent viewing of a recording of the program;

identifying customer premises equipment devices that recorded the program without subsequently playing back the program; and adjusting the popularity to reflect the customer premises equipment devices that recorded the program without subsequently playing back the program.

2. The method of claim 1, wherein determining the popularity includes determining an average of the number of customer premises equipment devices accessing the program.

3. The method of claim 2, wherein determining the average includes:

obtaining a plurality of viewership samples by periodically determining the number of customer premises equipment devices accessing the first multimedia program; and averaging the plurality of viewership samples.

4. The method of claim 2, further comprising:

determining a number of customer premises equipment devices that are powered-on in the viewing area.

5. The method of claim 4, wherein determining the popularity includes determining the popularity based, at least in part, on the number of powered on customer premises equipment devices in the viewing area.

6. The method of claim 5, further comprising: determining a number of powered on televisions attached to the powered on customer premises equipment devices in the viewing area and wherein determining the popularity includes determining the popularity based, at least in part, on the number of power on televisions in the viewing area.

7. The method of claim 3, further comprising:

storing, by a ratings server, the plurality of viewership samples.

8. The method of claim 7, further comprising receiving an indication of a channel change request via a client facing tier switch.

9. The method of claim 8, wherein the storing occurs in response to receiving traffic sent through the client facing tier switch.

10. The method of claim 8, further comprising:

monitoring for the channel change request, wherein the channel change request is sent from a set top box.

11. The method of claim 10, wherein the monitoring includes port-mirroring, at the client facing tier switch, to monitor substantially all packets sent from the client facing tier switch to the set top box.

12. A non-transitory computer readable medium, including processor executable program instructions that, when executed by a processor, cause the processor to perform operations comprising:

accessing, in a most recent channel table, information indicative of a most recent channel accessed by each active customer premises equipment device in a viewing area of a provider network;

updating the most recent channel table in response to detecting any customer premises equipment device in the viewing area requesting a channel change; and determining, from the most recent channel table, a popularity of a first multimedia program;

wherein determining the popularity includes:

determining a number of customer premises equipment devices accessing the first multimedia program;

determining a number of customer premises equipment devices recording the first multimedia program;

requesting the customer premises equipment devices recording the program to provide notification in response to a subsequent viewing of a recording of the program;

identifying customer premises equipment devices that recorded the program without subsequently playing back the program; and adjusting the popularity to reflect the customer premises equipment devices that recorded the program without subsequently playing back the program.

13. The non-transitory computer readable medium of claim 12, wherein determining the popularity includes:

measuring a number of set top box that are powered-on in the viewing area; and determining the popularity based, in part, on the number of set top boxes powered on.

14. The non-transitory computer readable medium of claim 12, wherein the operations include:

measuring a number of televisions that are powered-on in the viewing area.

15. A ratings server, comprising:

a processor;

a computer readable medium, accessible to the processor, including processor executable program instructions, wherein the program instructions, when executed by the processor, cause the processor to perform operations comprising:

accessing, in a most recent channel table, information indicative of a most recent channel accessed by each active customer premises equipment device in a viewing area of a provider network;

updating the most recent channel table in response to detecting a customer premises equipment device in the viewing area requesting a channel change; and determining, from the most recent channel table, a popularity of a first multimedia program;

wherein determining the popularity includes:

determining a number of customer premises equipment devices accessing the first multimedia program;

determining a number of customer premises equipment devices recording the first multimedia program;

requesting the customer premises equipment devices recording the program to provide notification in response to a subsequent viewing of a recording of the program;

identifying customer premises equipment devices that recorded the program without subsequently playing back the program; and adjusting the popularity to reflect the customer premises equipment devices that recorded the program without subsequently playing back the program.

16. The ratings server of claim 15, wherein determining the average number of viewers includes obtaining a plurality of viewership samples by periodically determining the number of customer premises equipment devices accessing the first multimedia program and averaging the plurality of viewership samples.

17. The ratings server of claim 16, wherein determining a number of customer premises equipment devices accessing the first multimedia program includes determining a number of customer premises equipment devices automatically recording the first multimedia program.

18. The ratings server of claim 17, wherein the adjusting includes adjusting the number of viewers based on whether the customer premises equipment devices automatically recording the first multimedia program subsequently play back the first multimedia program.

19. The ratings server of claim 18, wherein the adjusting includes receiving notification from the customer premises equipment device each time the first multimedia program is played back.

20. The ratings server of claim 15, wherein the operations include:

determining whether portions of the first multimedia program were skipped during subsequent play back.

21. The ratings server of claim 20, wherein determining whether portions of the first multimedia program were skipped includes determining whether commercials in the first multimedia program were skipped.

* * * * *